United States Patent [19]

Chomka et al.

[11] Patent Number: 4,846,241

[45] Date of Patent: Jul. 11, 1989

[54] SCREEN CLOSURE FOR GARAGE DOOR OPENINGS

[76] Inventors: Frank Chomka; Ina T. Chomka, both of 3816 Mendon Rd., Cumberland, R.I. 02864

[21] Appl. No.: 153,119

[22] Filed: Feb. 8, 1988

[51] Int. Cl.[4] ..... E06B 9/08

[52] U.S. Cl. ..... 160/23.1; 160/268.1; 160/290.1

[58] Field of Search ..... 160/23.1, 41, 242, 266, 160/268.1, 290.1, 319

[56] References Cited

U.S. PATENT DOCUMENTS

| | | | |
|---|---|---|---|
| 1,544,702 | 7/1925 | Trifari | 160/23.1 X |
| 1,716,285 | 6/1929 | Szako | 160/41 |
| 1,736,527 | 11/1929 | Garcia | 160/23.1 X |
| 1,793,195 | 2/1931 | Roberts | 160/23.1 |
| 1,843,731 | 2/1932 | Petro | 160/23.1 |
| 3,146,824 | 9/1964 | Veilleux | 160/23.1 |
| 3,991,805 | 11/1976 | Clauss | 160/22 |
| 4,252,172 | 2/1981 | Pommat et al. | 160/322 |
| 4,436,137 | 3/1984 | Charles | 160/268.1 X |
| 4,499,937 | 2/1985 | Waine et al. | 160/41 |
| 4,673,019 | 6/1987 | Silverthorne et al. | 160/268.1 |

*Primary Examiner*—Ramon S. Britts
*Assistant Examiner*—David M. Purol
*Attorney, Agent, or Firm*—Robert J. Doherty

[57] ABSTRACT

A roll-up screen enclosure for attachment to a garage door frame such that its extension provides a screened closure for an open garage door thus providing more useful space for living or recreational activities. The rolled up screen rests in a trough with waterproof features.

5 Claims, 1 Drawing Sheet

SCREEN CLOSURE FOR GARAGE DOOR OPENINGS

BACKGROUND AND OBJECTS OF THE INVENTION

This invention relates to a screen closure for openings and more particularly for the main door opening of a garage.

Extra housing space and especially that for use in mild weather is at a premium considering the high cost of modern construction. A potential source of added usable space is the garage normally included in such construction but not directly utilized in a meaningful way by the owners, that is, garages are normally used to house vehicles or even general storage of lawn and garden equipment, bicycles, and outdoor furniture. It would, accordingly, be advantageous to expand living or recreational space by using the garage area.

It has been proposed, such as set forth in U.S. Pat. No. 4,673,091 issued June 16, 1987, that a roll-up apparatus be provided such that the main automobile-sized garage door opening may be covered by a screen such that an additional recreational area at relatively low cost can be achieved. In its broad aspect, such patent relates to a roll-up apparatus comprising a rod having one edge of a flexible screen attached thereto and means for rotatably mounting such rod to a garage door frame wherein the screen is provided with means to releasably attach its side edges to the side members of the garage door frame and means for maintaining its bottom edge in contact with the ground or other supporting surface when the screen is in the lowered position. While such proposed device theoretically provides means for the stated purpose, its structure is primarily related to the mounting and operational use of such apparatus on the inside garage header structure.

Accordingly, it would be desirable if such a device could be provided for use in alternate positioning both on the front outside surface of a garage and the inside surface thereof and, accordingly, provide more accessible and flexible use of the device depending on the garage construction.

A further object of the present invention is to provide a screen closure apparatus for the main garage door opening which operates in a smooth, easy, and trouble-free manner and provides effective intended protection from insects and the like for those using the modified garage.

A still further object of the present invention is to provide a screen closure apparatus which provides the aforementioned features and also is of essentially weatherproof construction and can be manufactured at a relatively low cost.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DETAILED DESCRIPTION OF THE INVENTION

Figure 1:
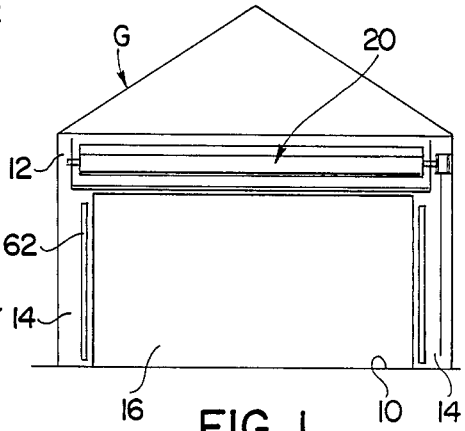
FIG. 1 is a front elevational view of a garage with the device of the present invention mounted thereon.

Referring now to the drawings and more particularly to FIG. 1 thereof, the construction of a garage G including a floor or other supporting surface 10 is depicted. In addition, the garage includes a header 12 and opposite side walls 14 in essence defining a main opening 16. It is this main opening 16 that is adapted to be, in effect, covered by the screen closure apparatus 20 of present invention.

Such apparatus 20 includes an elongated substantially rigid housing 22 which in turn includes a substantially U-shaped trough 24 having a cover portion 26 such that an open slot 28 is formed therebetween at the forward side thereof. The housing 22 is of elongated configuration and is adapted for side to side position on the header 12 of the garage G for such purpose. A plurality of laterally spaced and vertically positioned ribs 30 are integral with the trough 24 and in turn provided with laterally extending flanges 32 having openings (not shown) for affixation to the header 12 with screw means 34.

Intermediate the ribs 30 and projecting through laterally extending openings 36 in the trough 24 are a series of rollers 38 which project into the interior space of the trough 24 through such openings 36. The rollers 38 are mounted for free rotation at opposite ends thereof in trunnions 40 in turn attached to the bottom of the trough 24 with screws or the like via flanges 42.

Figure 2:
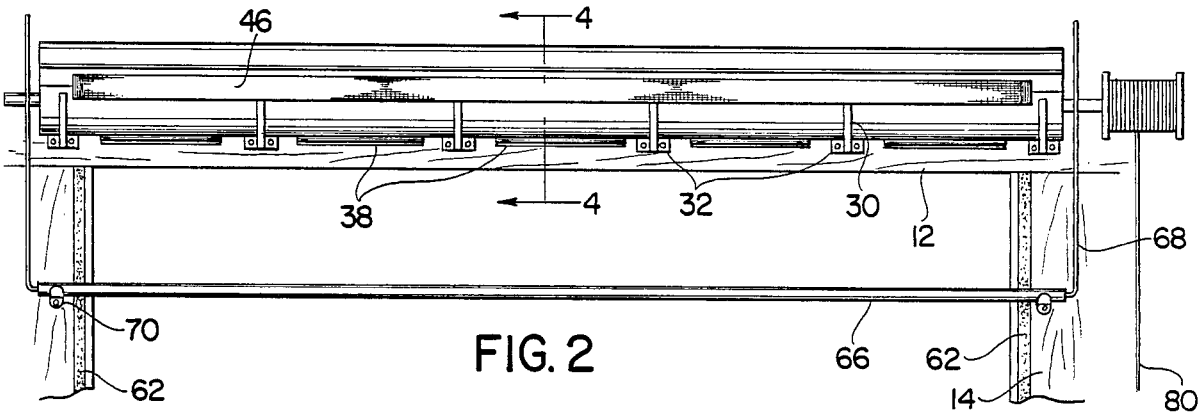
FIG. 2 is an enlarged front elevational view showing the screen closure in its front or storage position.
Figure 4:
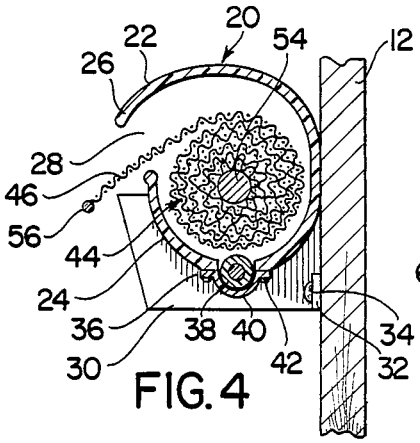
FIG. 4 is a cross-sectional view on an enlarged scale along the line 4–4 of FIG. 2.
Figure 3:
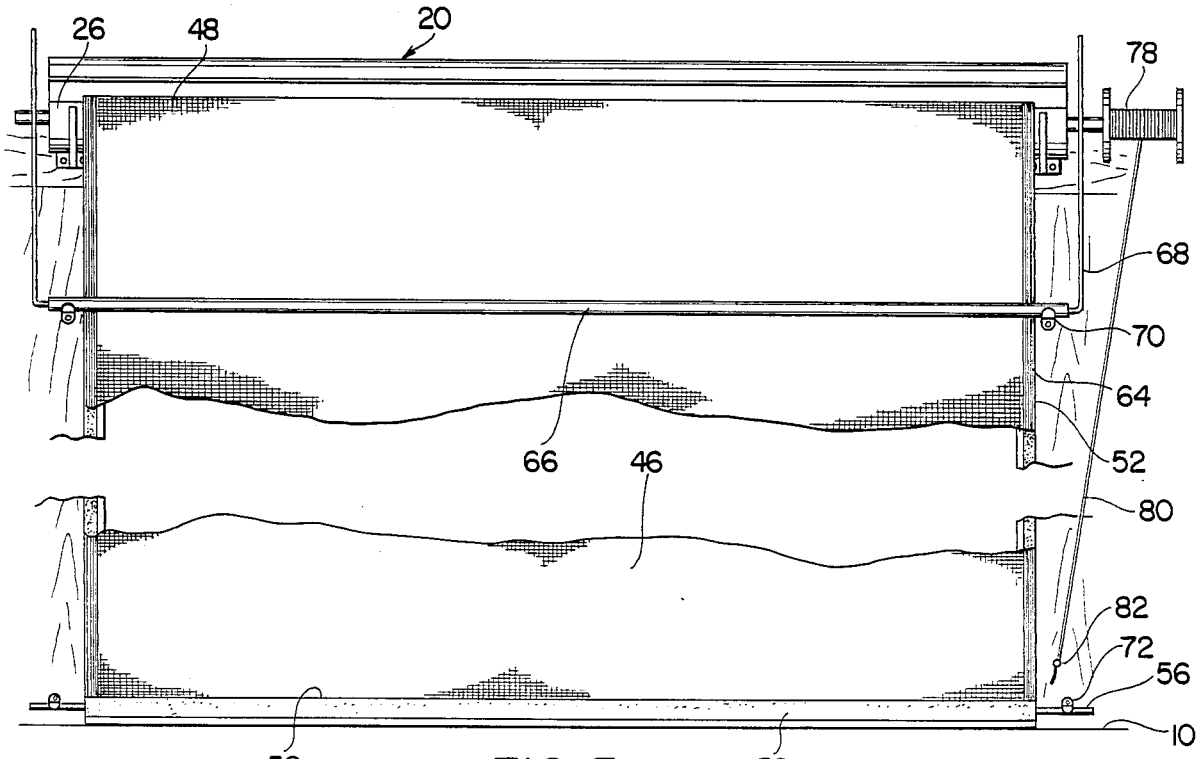
FIG. 3 is a view similar to FIG. 2 showing the screen in its fully extended position thereby providing a screen enclosure to the main opening of the garage door.

A screen roll 44 in turn comprising a large generally rectangular screen 46 preferably formed of fiberglass material or any other suitable material and of a generally rectangular configuration having an upper edge 48, a lower edge 50, and opposed side edges 52 is provided. The top or upper edge 48 is in turn fastened to an elongated laterally extending shaft 54 such that when the screen is wound upon itself it forms the screen roll 44 with the lower edge 50 thereof partially extending or adapted to extend through the slot 28 such that the screen 46 may be extended as shown in the transition between FIGS. 2 and 3 to its extended use position. To facilitate such action, the lower edge 50 of the screen 46 may be attached to a rod 56 which in turn may be provided with a foam sleeve or cylinder 58 positioned centrally thereof such that a sealing engagement with the ground 10 is achieved when the screen is lowered to its extended position as shown in FIG. 3.

The sides 52 of the screen 46 are each provided with a running strip of one portion of a two-piece loop and pile cooperating attaching means such that the screen may be firmly adhered to the garage side walls 14 via the provision of the remainder of the loop and pile attachment means attached in strip form to such side walls 14. Such loop and pile attachment means 60 is available under the trademark VELCRO. In other words, a cut loop material strip 62 is affixed by a conventional means to the side walls 14 and the pile fabric strip 64 is attached to the edges 52 or visa versa such that when the screen 46 is moved to its extended position as shown in FIG. 3, one can press the cooperating strips 62 and 64 together such that a tight attachment of the screen to the side walls is provided.

To ensure that the upper part of the screen 46 that is proximal to the header 12 is tightly engaged to the side walls 14 when desired, a pressure bar 66 may be provided. Such bar 66 extends across the screen 46 and includes supporting arms 68 on opposite sides thereof which may be attached to the shaft 54 for pivotal movement therewith. Supports or catches 70 are provided proximal to the header 12 on the side walls 14 such that the bar 66 may rest thereon, and in this manner the pressure bar weight assures that the upper portion of the screen will be firmly engaged to the garage. Also, similar supports or catches 72 may be provided on the side walls 14 proximal the ground or supporting surface 10 such that the rod 56 is positioned therebeneath such that the rod will not tend to rise up. The catches 72 thus form holding means for the shaft 54 and thus in combination with the cut loop and pile attachment means assures that the screen will remain in its fully extended or operational position as shown in FIG. 3. Also, the catches 72 are positioned such that the cylinder 58 preferably engages the supporting floor 10 when the rod 56 is engaged by the catches 72.

In order to raise and lower the screen, the shaft 54 may be provided with a drum 78 at one end thereof on which a cord 80 is wound and through which shaft 54 manipulation may be conveniently achieved. Such movement of the shaft 54 either alone or in combination with a pulling action on the forward end of the screen as by grasping the rod 56 achieves both the lowering of the screen 46 to its use position and its upward movement to its storage position. During such manipulation, the screen roll 44 is supported within the trough 24 and its rotation enhanced by contact with the rollers 38. In this regard, it should be pointed out that secondary rollers (not shown) may also be utilized to facilitate this purpose. It should also be pointed out that the trough cover 26 preferably overhangs the front slot 28 to provide a weatherproof enclosure for the screen roll 44 such that the apparatus 20 is equally appropriate for mounting on either the outside of the garage or the inside thereof. Also, a cleat 82 is provided to secure the cord 80 in its extended position or any desired intermediate position therebetween.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A screen closure for the main opening of a garage in turn having a main opening, a header structure having inside and outside surfaces thereabove and sidewalls on opposite sides thereof, said closure comprising an elongated substantially rigid housing adapted for mounting on either surface of said header for side to side positioning above said opening and extending to each of said opposite garage sidewalls, said housing including an elongated generally U-shaped trough having an upwardly forwardly directed cover and a forwardly directed open slot, a screen roll assembly mounted in said trough, said roll assembly comprising an elongated shaft and a flexible screen in turn having upper, lower and opposite side edges with the upper edge of said flexible screen attached to said shaft and with the remainder of said screen adapted to move between a first storage position wherein said screen is wound about said shaft with only said lower edge projecting outwardly of said slot and a second fully extended position wherein said screen is unwound from said shaft and positioned over said garage main opening, means for rotating said shaft and thus positioning said screen in said aforementioned positions, and cooperating attachment means on the opposite side edges of said screen and the opposite sidewalls of said garage for removably affixing said screen sides to said sidewalls said lower end of said screen attached to a laterally extending rod, and holding means positioned on the opposite lower sidewalls for temporarily attaching said rod to said sidewalls at said fully extended screen position, said housing including a plurality of laterally-spaced, vertically-oriented, forwardly-projecting stiffening ribs with integral header attachment flanges for positioning said housing to said garage, said trough including a plurality of laterally extending and laterally spaced cut-outs, rollers projecting into said trough between said ribs and in turn supporting said screen roll assembly for rotational movement between said positions.

2. The screen closure of claim 1, said rod means including a centrally positioned foam sleeve for contact with said lower side walls and the supporting surface of said garage for a sealing relationship therewith.

3. The screen closure of claim 1 including screen pressing means laterally extending across the header and below said housing for contacting said screen at the upper portions thereof so as to force said screen against said header.

4. The screen closure of claim 3, said screen pressing means being a closure bar pivotally attached to said housing and laterally extending across said header for contact with said screen.

5. The screen closure of claim 1, said cooperating attachment means being of loop and pile construction.

* * * * *